US006591839B2

(12) United States Patent
Meyer et al.

(10) Patent No.: US 6,591,839 B2
(45) Date of Patent: Jul. 15, 2003

(54) FILTER MATERIAL FOR REDUCING HARMFUL SUBSTANCES IN TOBACCO SMOKE

(76) Inventors: Dieter Meyer, Erlengrundstrasse 45, D-31542 Bad Nenndorf (DE); Hans-Peter Braun, Bahnhofstrasse 6, D-31535 Neustadt (DE)

( * ) Notice: Subject to any disclaimer, the term of this patent is extended or adjusted under 35 U.S.C. 154(b) by 300 days.

(21) Appl. No.: 09/820,233

(22) Filed: Mar. 28, 2001

(65) Prior Publication Data

US 2001/0045215 A1 Nov. 29, 2001

Related U.S. Application Data

(63) Continuation-in-part of application No. 09/413,712, filed on Oct. 5, 1999, now abandoned.

(30) Foreign Application Priority Data

Feb. 17, 1999 (DE) ..... 199 06 549

(51) Int. Cl.[7] ..... A24D 1/04; A24F 1/20; A24F 7/04; A24F 13/06

(52) U.S. Cl. ..... 131/202; 131/201; 131/331; 131/332; 131/334; 131/341; 131/342; 131/346

(58) Field of Search ..... 131/201, 202, 131/331, 332, 334, 341, 342, 346

(56) References Cited

U.S. PATENT DOCUMENTS

| | | | |
|---|---|---|---|
| 1,985,840 | A | 12/1934 | Sadtler |
| 2,108,860 | A | 2/1938 | Kauffman |
| 2,181,614 | A | 11/1939 | Striefling |
| 3,251,365 | A | 5/1966 | Keith, II et al. |
| 3,347,245 | A | 10/1967 | Hawkins |
| 3,428,054 | A | 2/1969 | Scarabello et al. |
| 3,557,801 | A | 1/1971 | Jamison |
| 3,608,563 | A | 9/1971 | Schmitz |
| 3,650,279 | A | 3/1972 | Gansloser |
| 3,658,069 | A | 4/1972 | Wise et al. |
| 3,669,126 | A | 6/1972 | Soussa et al. |
| 3,875,949 | A | 4/1975 | Harendza-Harinxma et al. |
| 4,201,234 | A | 5/1980 | Neukomm |
| 4,306,576 | A | 12/1981 | Moon et al. |
| 4,729,389 | A | 3/1988 | Anderson |
| 4,740,488 | A | 4/1988 | Fogler et al. |
| 5,129,409 | A | 7/1992 | White et al. |
| 5,346,674 | A | 9/1994 | Weinwurm et al. |
| 5,404,890 | A | 4/1995 | Gentry et al. |
| 5,976,490 | A | 11/1999 | Wendelbo |

FOREIGN PATENT DOCUMENTS

| | | |
|---|---|---|
| AT | 368 686 | 10/1982 |
| AT | 372 824 | 11/1983 |
| DE | 15 17 298 | 2/1969 |
| DE | 15 17 272 | 1/1970 |
| DE | 29 25 001 | 1/1981 |
| DE | 87 06 686.6 | 8/1987 |
| EP | 0 740 907 | 11/1996 |
| WO | WO96/07335 | 3/1996 |

*Primary Examiner*—Michael Colaianni
(74) *Attorney, Agent, or Firm*—Collard & Roe, P.C.

(57) ABSTRACT

A filter material for reducing the content of harmful substances in tobacco smoke. The filter material comprises a ground and not additionally activated expanded clay produced without adding foreign substances, and zeolite as the filter material. The filter is suitable for tobacco products such as cigarettes, cigars and cigarillos, and for smoking articles such as tobacco pipes and cigarette and cigar holders.

12 Claims, 1 Drawing Sheet

FILTER MATERIAL FOR REDUCING HARMFUL SUBSTANCES IN TOBACCO SMOKE

CROSS REFERENCE TO RELATED APPLICATIONS

This is a continuation-in-part of U.S. patent application Ser. No. 09/413,712, filed on Oct. 5, 1999 now abandoned and benefit is claimed under 35 U.S.C. §120. Benefit is also claimed under 35 U.S.C. §119 of German Application No. 199 06 549.7 filed Feb. 17, 1999.

BACKGROUND OF THE INVENTION

1. Field of the Invention

The invention relates to a filter material for reducing harmful substances in tobacco smoke.

2. The Prior Art

Tobacco smoke is produced when tobacco is burning down. Said smoke is an aerosol consisting of a gas phase and a condensate phase. The gas phase of the tobacco smoke has a relatively simple composition and, in addition to nitrogen, oxygen, carbon dioxide, hydrogen and inert gases, also contains the toxic substances carbon monoxide (about 4.2%), hydrogen cyanide (about 0.16%), ammonia (about 0.03%), nitrogen oxides (about 0.02%), and traces of hydrogen sulfide. On the other hand, the main component of ingredients is found in the condensate phase ("tar"), including also the flavoring and odorous substances forming the aroma of tobacco smoke.

It is known since a long time that smoking is harmful to health in the long run. It has not as yet been entirely clarified which components of tobacco smoke in detail exactly cause the effects, which are observed to varying degrees depending on the smoking habits, the tobacco consumption and the constitutional disposition of the smoker, etc. The statistically increased susceptibility of smokers to arteriosclerosis, coronary diseases and myocardial infarction, as well as the tendency to gastrointestinal diseases are ascribed to the effects of nicotine, and attributed to some extent also to the effects of carbon monoxide. Another toxic substance, namely hydrocyanic acid, inhibits the regeneration of the ciliary epithelium in the respiratory tract, and prevents the formation of leukocytes. The very frequent occurrence of diseases in the region of the pharyngeal space, and in particular the occurrence of bronchitis (smoker's cough) are associated with the phenol, acid, aldehyde and ketone components of tobacco smoke.

Filter cigarettes, filter cigars and filter cigarillos, as well as cigarette and cigar holders and tobacco pipes have been developed for reducing the content of harmful substances in tobacco smoke, with mouthpieces containing filter materials for removing part of the nicotine and tar substances without substantially filtering out the aroma substances. Such filter materials consist of cellulose, cellulose acetates, polyethylene, crepe and paper, or active carbon.

Silicate-containing minerals, in particular clay, kaolin and feldspat are used as adsorbents for tobacco filters according to DE-OS 15 17 272. However, the drawback is that said filter materials, according to the laid-open specification of said patent, have to be made free of adhering ions by means of a treatment with distilled water or acids, or by electrolysis or electrodialysis, in order for them to be usable. Furthermore, mainly tar substances of the condensate phase and less the toxic substances of the gas phase are reduced.

Furthermore, filter materials are used which form a film, and which consist of a binding agent such as methyl cellulose and a finely fibrous material, the latter being provided with adsorbents. Active carbon, silica gel, asbestos fibers or polyethylene glycol are specified as adsorbents. Said filter material offers the advantage of filtering out defined harmful substances, in the present case primarily phenol, by applying selectively acting absorbents. In addition to the use of asbestos fibers, which have been proven to cause cancer, the drawback in this case is that the major part of the flavoring and odorous substances of the tobacco aroma is filtered out.

DE-OS 15 17 298 specifies filter materials consisting of active carbon grains with a maximum diameter of 0.1 to 2 mm, which are linked via a vehicle such as polyvinyl resin or polyethylene. Again, the drawback is that mainly the tar substances and thus also the flavoring and odorous substances of the tobacco smoke aroma are filtered out, but not the toxic components of the gas phase such as carbon monoxide, hydrocyanic acid or ammonia.

According to DE design patent 87 06 686, another filter material consists of a mixture of active carbon particles and meerschaum (sepiolite), which serves for reducing the tar substances, harmful substances and the nicotine, as well as the odorous substances. Meerschaum or sepiolite represents a porous mineral, which adsorbs much moisture in addition to tar substances and nicotine. The adsorptive effect of the active carbon for odorous, harmful and tar substances is increased by binding the moisture. However, the drawback is that in addition to the odorous substance, the flavoring substances of the tobacco smoke aroma are filtered out as well.

In German laid-open document DE-OS 29 25 001, mention is made of clays as filter materials, which can be applied to carrier materials such as cellulose acetate fibers or paper because of their gel- and film-forming properties. Decisive for the application of such materials is their swelling property. Therefore, primarily bentonites such as sodium montmorillonite and sodium attapulgite are suitable.

Furthermore, filters are known for cigarettes, cigars, cigarillos, cigarette and cigar holders as well as tobacco pipes which contain either pure silica gel or pure active carbon.

The drawback of such filter materials is that they predominantly reduce the tar substances of the condensate phase, but less so the toxic substances of the gas phase. Since the flavoring and odorous substances forming the aroma of tobacco smoke are present also in the condensate phase, and reduced jointly with the tar substances, the utilization of such filter materials has a negative influence on the pleasure of smoking. A further drawback of such materials is the short duration of the filtration effect of said filter materials. Particularly with filter materials used in cigarette and cigar holders as well as in tobacco pipes, which are reused many times, the degree of saturation and thus the loss of filtration efficiency are reached in a relatively short time. Furthermore, the smoker is required to apply increased drawing force when smoking with some filter materials because the density of the filter material is so great that the tobacco smoke will not freely flow through the filter material.

SUMMARY OF THE INVENTION

The invention is based on the problem of providing a filter material which, in addition to improving the reduction of the tar substances present in the condensate phase, eliminates the toxic substances of the gas phase as completely as possible without reducing at the same time the aroma of the tobacco smoke and thus the flavoring and odorous substances. Furthermore, the goal of the invention is to provide a filter material that assures long-lasting filtration efficiency and permits easy passage of the tobacco smoke through such filter material without requiring the smoker to apply increased drawing force during smoking.

This object is accomplished by a filter material that comprises a ground and not additionally activated expanded clay produced without adding foreign substances, as well as zeolite. The expanded clay is a synthetically produced filter material based on natural lime-containing raw clay. To produce the expanded clay, the natural raw or crude clay is shaped into small, round pieces and subsequently burned in special calcinators, so-called rotary tubular furnaces, at a high temperature (about 1200° C.) with a feed of air.

The small round pieces are first caused to expand in the course of the burning process under heat, and the surfaces of the small spheres of clay are then slightly sintered (melted). The interior of the small spheres has a porous structure with numerous air inclusions. The expanded clay is thereafter ground.

Therefore, the expanded clay is produced without adding any foreign substances. An expanded clay so produced has an optimal filtration effect and does not need to be additionally activated. Thus, there is no additional process required to turn the ground expanded clay into a more reactive activated condition.

By using expanded clay as filter material for tobacco products such as cigarettes, cigars or cigarillos, and for smoking utensils such as tobacco pipes, cigarette and cigar tips, the harmful substances of the condensate phase and in particular of the gas phase are very highly reduced without negatively influencing at the same time the flavor and the odor of the aroma of the tobacco smoke.

The advantage of using expanded clay instead of untreated clay lies in the fact that expanded clay, because of its production process (burning process at 1200° C.), has air cavities and air ducts extending through it, so that the surface for adsorbing the harmful substances present in the tobacco smoke is enlarged. The fine ducts favor in this connection the precipitation of condensate and of the harmful substances contained therein.

Furthermore, expanded clay is characterized by its low swelling property and the dimensional stability associated therewith, which prolongs the duration of the filtration effect. The large surface area of expanded clay, because of the large contact area between the filter material and the tobacco smoke, assures a long-lasting filtration effect. The drawing force the smoker is required to apply for smoking changes unnoticeably when expanded clay is employed; the smoke flows without obstruction through the filter material with good surface contact.

By using zeolite as filter material, harmful substances of the condensate phase and gas phase are minimized as well. In the present case too, a material is employed which, on account of its surface structure, is characterized by cavities and ducts, and significantly suitable for filtering out the harmful substances of the tobacco smoke while having only minor influence on the aroma of the tobacco smoke.

The advantage of zeolite over other silicate-containing minerals such as silica gel and clays consists in its surface structure, which has excellent hydration, ion exchange and molecular screen properties. As compared to conventional, commercially available silicone-containing filter materials, this improves the reduction of harmful substances in the gas and condensate phase of tobacco smoke.

Furthermore, in spite of their surface areas, the two materials expanded clay and zeolite take up only little volume, so that a small amount of material suffices for good filtration effects.

According to a further development of the invention, provision is made that the filter material is a composition of expanded clay and zeolite. The composition may vary within wide limits.

In this way, the filtration effect is improved as compared to the one of the individual substances in spite of using only the same amount of filter material. The improvement of the filtration effect has to be attributed to the fact that the individual substances mutually positively influence each other with respect to their activity, i.e., with respect to their efficiency in adsorbing harmful substances.

Furthermore, it is possible to add components in the form of active carbon particles to the expanded clay, the zeolite, or to the mixture of expanded clay and zeolite.

The filtration properties are intensified beyond the additive measure of the individual components in this way as well. The composition may vary within wide limits. The proportion of active carbon particles is dimensioned in this connection in such a way that the influence on flavoring and odorous substances remains as low as possible.

The filter material may be in the form of granulate with a grain size with a diameter in the range of 0.1 and 2 mm.

The upper limit of the grain size is to assure that adequate packing density and a sufficient degree of filling are obtained, and that mixing or at least partial penetration of the filter materials may occur as well. The lower limit is to avoid excessive flow resistance and to prevent very small particles from being carried along by the flow and from exiting from the filter.

Zeolite having a finely fibrous structure is preferably employed; this prevents fine fibers from getting detached and from being carried along by the flow and inhaled.

According to a further development of the invention, provision is made that the substances forming the filter material are usable unmixed next to each other in the form of a multiphase system.

This increases the filtration efficiency and filtration capacity. In a two-phase system, for example, harmful substances of the tobacco smoke are filtered out in the first phase; such harmful substances otherwise negatively influence the filtration effect of the second phase. Accordingly, in a multiphase system, the phases can be arranged in such a way that the best possible mutual positive influencing of the filter materials is achieved for reducing the harmful substances of the tobacco smoke.

Furthermore, the substances forming the filter material can be used also intermixed in the form of a mixed-phase system.

In this way, the filtration effect and filtration capacity are increased selectively for individual harmful substances.

Such an increase is caused by the close contact between the filter materials and the mutual positive influencing of their filtration effects and capacities resulting therefrom.

Furthermore, provision is made that the filter materials are usable without activation.

In this way, no costly pretreatments (washing with acids, lyes or $H_2O$; heating; swelling; homogenizing; drying; etc.) of the filter materials are required, which, as a rule, means cost savings. (Swelling refers to a process that changes the volume of a solid when it is acted upon by liquid.)

The filter preferably comprises a consumption indicator.

In this way, the end of the adsorption capacity for adsorbing harmfull substances is optically indicated on the filter materials. Starting from a defined indication, the filter should be replaced because the adsorptive power of the filter material is getting too low for effectively minimizing the harmful substances contained in the tobacco smoke.

In a practical realization, the consumption indicator may consist of marble.

The end of the adsorption capacity for adsorbing harmful substances on the filter materials is indicated in this way by a discoloration of the marble from light to dark, and the filter should be replaced starting with a defined depth of the color.

Cellulose has the same property as marble in this regard. With cellulose, too, a certain dark coloration indicates the end of the capacity for adsorbing harmful substances. As opposed to marble, however, cellulose additionally has a filtering property. When cellulose is used mixed with the materials specified above, the filter has an above-average filtration effect. The proportion of cellulose in the mixture is limited in that when higher proportions are used, the drawing force which the smoker has to apply during smoking is highly raised, while the flavor and odor of the tobacco diminish ar the same time.

The consumption indicator is preferably arranged downstream of the filter material in the direction of flow. Such an arrangement offers the advantage that a visual change sets in only when the filter materials are almost consumed. When this situation exists, the change in the consumption indicator accors rapidly, signaling the end of the usability of the filter in a clear manner.

BRIEF DESCRIPTION OF THE DRAWINGS

Exemplified embodiments of the invention are explained in the following with the help of the drawing, in which.

DETAILED DESCRIPTION OF THE PREFERRED EMBODIMENT

Figure 1:
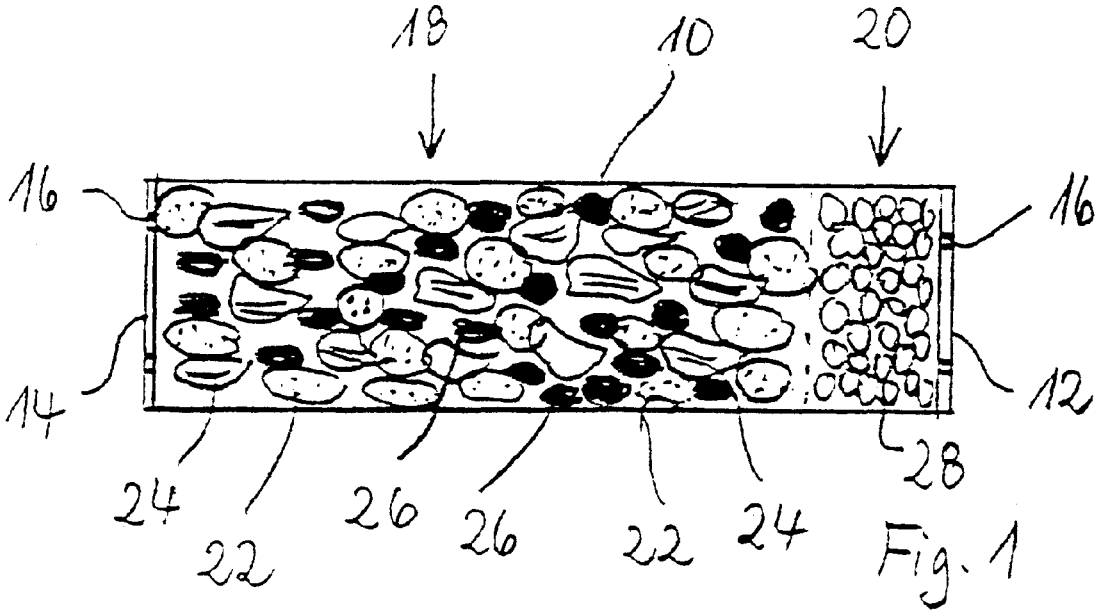
FIG. 1 shows a longitudinal section through a filter with a mixed-phase system.

The filters shown in the drawing each have a cylindrical casing 10, into which a mouthpiece can be inserted, or which can be produced also together with a cigarette. Casing 10 is terminated by a first end piece 12 and a second end piece 14, said end pieces fixing the materials present in casing 10. End pieces 12 and 14 are provided with apertures 16, which permit passage of the tobacco smoke, but keep back the materials present in casing 10. Filter material is present in a filter zone 18, and a consumption indicator 28 is arranged in an indicator zone 20. The tobacco smoke passes through the filter from the left to the right in the representation shown in the drawing, so that the smoke flows first through filter zone 18 and then through indicator 20.

The filter shown in FIG. 1 is a mixed-phase system. The filter materials are arranged mixed in filter zone 18. In detail, said materials are expanded clay, zeolite and active carbon in the form of granulates. The grain size may vary between 0.1 and 2 mm. A mixed-phase system is particularly advantageous of housing 10 is filled with the filter materials on a machine, and when a uniform ratio of the components of the individual filter materials is desired in this connection. Filter zone 18 is adjoined by indicator zone 20, which is filled with an indicator material 28, which is marble in the present case. The marble material is present in the form of granulate as well.

Figure 2:
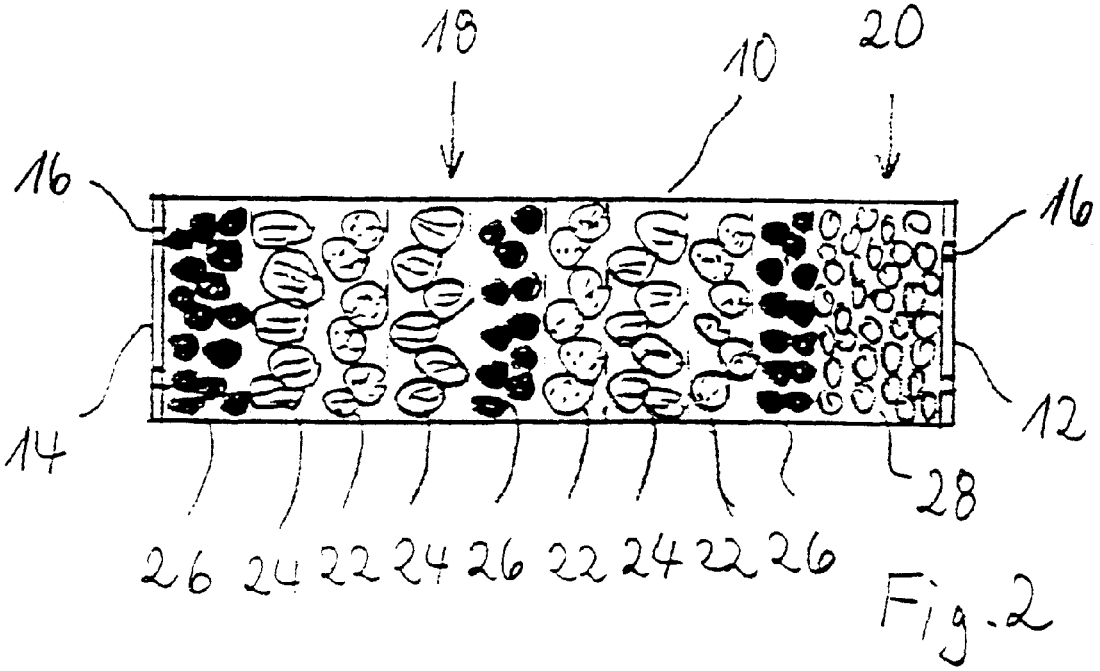
FIG. 2 shows a longitudinal section through a filter with a multiphase system.

The filter shown in FIG. 2 is a multiphase system, where the filter materials are separately arranged in filter zone 18 in a number of successively arranged layers. In the exemplified embodiment shown, a layer 26 of active carbon is arranged first, followed by a layer 24 of zeolite, and subsequently a layer 22 of expanded clay. Thereafter, the three layers are repeated two times, but with different sequences. The present embodiment is advantageous for manual filling. The indicator zone 20 downstream of filter zone 18 corresponds with the one in FIG. 1. In the representation according to FIG. 2, the filter materials are present in the form of granulate as well. Also, the diameter range is the same as specified for FIG. 1.

What is claimed is:

1. A filter for reducing harmful substances in tobacco smoke, for tobacco products and smoking aids, wherein the filter material comprises ground and not additionally activated expanded clay produced without adding foreign substances, as well as zeolite.

2. The filter according to claim 1 wherein the filter material additionally comprises active carbon.

3. The filter according to claim 1 wherein the filter material is in the form of granulate with a grain size having a diameter in the range of 0.1 and 2 mm.

4. The filter according to claim 1 wherein the filter material further comprises an additional material and wherein the expanded clay and additional material are disposed next to one another as a multiphase system.

5. The filter according to claim 1 wherein the filter material further comprises additional material and wherein the expanded clay and additional material are disposed together as a mixed-phase system.

6. The filter according to claim 1 wherein the filter material is usable without activation.

7. The filter according to claim 1 wherein the filter additionally comprises a consumption indicator.

8. The filter according to claim 7, wherein said consumption indicator comprises marble.

9. The filter according to claim 7, wherein the consumption indicator comprises cellulose.

10. The filter according to claim 7, wherein said consumption indicator is disposed in a direction of flow downstream of the filter material, and wherein the direction of flow is the direction of tobacco smoke during inhalation.

11. The filter according to claim 1, wherein the tobacco products are selected from the group consisting of cigarettes, cigars and cigarillos.

12. The filter according to claim 1, wherein the smoking aids are selected from the group consisting of tobacco pipes, cigarette holders, and cigar holders.

* * * * *